US006815596B2

(12) United States Patent
Goto

(10) Patent No.: US 6,815,596 B2
(45) Date of Patent: Nov. 9, 2004

(54) THREAD SPOOL DEVICE FOR STRINGED INSTRUMENT

(75) Inventor: Takao Goto, Isesaki (JP)

(73) Assignee: Gotoh Gut Co., Ltd., Isesaki (JP)

( * ) Notice: Subject to any disclaimer, the term of this patent is extended or adjusted under 35 U.S.C. 154(b) by 0 days.

(21) Appl. No.: 10/475,529

(22) PCT Filed: May 2, 2001

(86) PCT No.: PCT/JP01/03798

§ 371 (c)(1),
(2), (4) Date: Oct. 30, 2003

(87) PCT Pub. No.: WO02/091350

PCT Pub. Date: Nov. 14, 2002

(65) Prior Publication Data

US 2004/0123720 A1 Jul. 1, 2004

(51) Int. Cl.[7] ..... G10D 3/14

(52) U.S. Cl. ..... 84/304; 84/305; 84/306; 84/303

(58) Field of Search ..... 84/304, 305, 306, 84/303

(56) References Cited

U.S. PATENT DOCUMENTS

| | | | | |
|---|---|---|---|---|
| 4,353,280 A | * | 10/1982 | Spercel | 84/306 |
| 4,515,059 A | * | 5/1985 | Siminoff | 84/306 |
| 4,643,069 A | | 2/1987 | Borisoff et al. | |
| 6,703,547 B2 | * | 3/2004 | Hovermann et al. | 84/304 |

FOREIGN PATENT DOCUMENTS

| | | |
|---|---|---|
| JP | 49-72228 | 6/1974 |
| JP | 53-48662 | 11/1978 |
| JP | 54-29093 | 9/1979 |
| JP | 54-135917 | 9/1979 |
| JP | 56-102590 | 8/1981 |
| JP | 62-80697 | 4/1987 |

* cited by examiner

*Primary Examiner*—Kimberly Lockett
(74) *Attorney, Agent, or Firm*—Armstrong, Kratz, Quintos, Hanson & Brooks, LLP

(57) ABSTRACT

A peg for a stringed instrument having rotatably supported, at the main body 20 for mounting at the head portion H of the stringed instrument, a worm wheel 30 having a winding shaft 40 at one end portion and a worm gear 33 which meshes with the worm wheel 30 and has a knob at one end portion, and at the worm wheel 30, a hole 31 having a portion with a non-circular cross-section is formed, and the winding shaft 40 is provided with a winding shaft main body 42 onto which string is wound and a closely fitting portion 43 which passes through the plate portion 24 of the main body 20 and has a smaller diameter than the winding shaft main body 42. The closely fitting portion 43 is screwed in by being closely fitted in the portion of the hole 31 having a non-circular cross-section and then inserting the tightening device 50 into the hole. The axial cross-section of the closely fitting portion 43 is slightly larger than the axial cross-section of the hole 31, and the closely fitting portion 43 is pressed into the hole 31 by the closely fitting device being tightened.

6 Claims, 7 Drawing Sheets

THREAD SPOOL DEVICE FOR STRINGED INSTRUMENT

BACKGROUND OF THE INVENTION

1. Technical Field

The present invention relates to a peg for a stringed instrument such as a guitar, and more particularly, relates to a peg for a stringed instrument in which the winding shaft rotates due to the tension of the string, and tuning is thereby made easy.

2. Background Art

The peg used in a stringed instrument such as a guitar generally comprises a worm gear provided coaxialy with respect to a knob, and a worm wheel which meshes with the worm gear and is provided coaxialy with respect to a winding shaft. In this type of peg, a large string tension acts on the winding shaft, and the string tension is often changed due to tuning of the string and choking made for a performance. In addition, because the peg must be mounted within a limited space at the head of the guitar, there are limitations with respect to the structure of the peg. Furthermore, since the peg is required to have a decorative appearance, the parts of the peg are often coated by plating or coating. For this reason, it is difficult to maintain the precision of size in the parts of the peg, and because of this situation, there have been problems hitherto with respect to the structure of the peg.

FIG. 7 shows a cross-sectional view of an example of a peg used in an electric guitar, a folk guitar, and the like. In the peg shown in FIG. 7, a main body 1 is mounted to a guitar head H, and a winding shaft 3 having a worm wheel 2 fixed to an end thereof is rotatably supported by the main body 1. A worm gear which meshes with the worm wheel 2 is rotatably supported by the main body 1, and a knob having the same axis as the worm gear is fixed to the worm gear (neither is shown).

The worm wheel 2 is closely fitted into the winding shaft 3 such that relative rotation with respect to an end portion thereof is prevented, and the worm wheel 2 is secured to the winding shaft 3 with a screw 4. In addition, a plate portion 1*a* of the main body 1 is disposed between the shoulder 3*a* of the winding shaft 3 and the bottom surface 2*a* of the worm wheel 2 with a gap. In addition, a screw 1*b* is formed on an inner surface of one end portion of the main body 1, and a securing nut 5 is screwed to the screw 1*b*. The winding shaft 3 is rotatably inserted through the securing nut 5.

In the peg described above, a leading end portion of the string is anchored at the string winding surface 3*b* of the winding shaft 3. When the knob is rotated, the string is wound. In the peg shown in FIG. 7, because the plate portion 1*a* of the main body 1 is disposed between the shoulder 3*a* of the winding shaft 3 and the bottom surface 2*a* of the worm wheel 2 with a gap there between them, the winding shaft 3 is rotatable in the direction of slackening due to the tension of the string. Accordingly, the surface of the teeth of the worm wheel 2 is always pressed in a set direction with respect to the surface of the teeth of the worm gear due to the string tension. This type of structure is used because in tuning, and the effects described in the following are achieved.

Specifically, when the string is tensioned, the winding gear 3 is rotated due to the surface of the teeth of the rotating worm gear being pressed against the surface of the teeth of the worm wheel. On the other hand, since the surface of the teeth of worm wheel 2 is pressed to the surface of the teeth of the worm gear in a constant direction, when the worm gear rotates in the direction of slackening of the string, the worm gear rotates along with the worm wheel 2 in the same direction. Accordingly, the string is slackened by the exact amount by which the knob is turned in real time, and this has the advantage that tuning is made easy.

Conversely, the conventional peg has a structure in which the plate portion 1*a* is tightened by shoulder 3*a* of the winding shaft 3 and the bottom surface 2*a* of the worm wheel 2. In this type of peg, since there is a large amount of frictional resistance between the winding shaft 3 and the main body 1, the winding shaft is not easily rotated by the string tension. Thus, if after the knob is rotated in one direction, and is rotated again in the opposite direction, there is a time lag corresponding to the amount of backlash of the worm gear and the worm wheel 2 generated between the time when the knob is first rotated until the time when the worm wheel 2 rotates. As a result, there is a problem in that tuning is difficult. In addition, after tuning in the direction of slackening of the strings has been completed, the worm gear may gradually rotate during backlash of the worm wheel 2 due to string tension, and the notes may become out of tune during performance. For this reason, at the time of tuning, a method must be used in which, the sound is adjusted while tensioning the string after the string has been sufficiently slackened, and this is the main reason why tuning is so difficult.

However, even in the winding device shown in FIG. 7, many kinds of problems have become apparent. That is to say, the gap between the plate portion 1*a* of the main body 1 and the worm wheel 2 and the shoulder 3*a* of the winding shaft 3 is set such that even if the winding shaft 3 becomes inclined due to the string tension, the winding shaft 3 never moves in the axial direction. However, the dimension of the gap may fluctuate with the precision of the processing or the thickness of the plating of the winding shaft 3 and the plate portion 1*a*. As a result, if the dimension of the gap is smaller than a set value, there is a large amount of frictional resistance between the winding shaft 3 and the main body 1, and thus, the same problems caused by backlash which are described in the foregoing occur.

On the other hand, if the distance of the gap is larger than the set value, a space is generated in the axial direction in which the winding shaft moves. For this reason when the direction of rotation of the worm gear changes, first the worm wheel 2 moves along with the winding shaft 3 in the axial direction, and when the winding shaft 3 reaches the moving end of the worm wheel 2, the rotation of the worm gear is transmitted to the worm wheel 2. That is to say, the gear is in the same state as it is when there is backlash. In addition, when the worm wheel 2 moves in the axial direction, the surface of the teeth thereof are abraded by the corners of the surface of the teeth of the worm gear, and as a result, errors in rotation are caused and a gap is formed between the surfaces of the teeth, thus hindering smooth rotation. Also, when the worm wheel 2 is forcibly rotated, the plate portion 1*a* bends, thus rendering the winding shaft unusable.

Furthermore, in the peg shown in FIG. 7 by providing the gap between the plate portion 1*a* of the main body 1 and the worm wheel 2 and also between the plate portion 1*a* of the main body 1 and the shoulder 3*a* of the winding shaft 3, the screw 4 must be fixed loosely. As a result, the screw 4 becomes even looser due to vibrations of the string at the time of performance, and due to sympathetic vibration, the screw may fall out. In an effort to eliminate this problem, the screw 4 has been fixed with an adhesive, but when this is done, repair of the peg becomes extremely difficult.

A peg in which a spring washer is disposed between a worm wheel and a plate portion has also been provided. In this type of peg, movement of the winding shaft in the axial direction is controlled and rotation due to string tensioning becomes possible. However, the material for forming the main body is generally made from a diecast product of soft metals such as aluminum or zinc or brass, or the like. As a result, there is a problem in that the spring washer which is caused to rotate along with the worm wheel shaves the main body. Furthermore, the axial direction position of the worm wheel may vary in accordance with the strength with which the screw is tightened, and more particularly, in a drum-shaped worm wheel, if the axial direction position is shifted, normal meshing of the worm wheel and the worm gear cannot be ensured, and thus there is abnormal wearing of the surface of the teeth. In addition, because the worm wheel is disposed on top of the spring washer, there is a tendency for the winding shaft and the worm wheel to tilt due to the string tension and this too interferes with the normal meshing of the gear.

By forming the closely fitting portion of the worm wheel and the winding shaft in a non-circular shape, relative rotation thereof is prevented. Ideally, there should be no gap between the worm wheel and the winding shaft when both are fitted each other. However, in consideration of variations in processing precision and in the thickness of the plating, a clearance is provided to a certain extent in which assembly is not hindered. As a result, there is idle in the direction of rotation between the worm wheel and the winding shaft, and as in the case of backlash of the gear, a time lag is generated in tuning.

FIG. 8 is a cross-sectional view of an example of another type of peg known as the bushing type. A main body 10 is mounted to the guitar head H by a screw, and a worm wheel 12 having a winding shaft 11 fixed to one end thereof is rotatably supported by a main body 10. A worm gear 13 having a knob (not shown) mounted to one end thereof is rotatably supported by the worm wheel 12. In addition, a hole 14 is formed in the head H, and a bushing 15 for guiding the winding shaft 11 is fit into the hole 14.

In this type of peg, it is difficult for the center of the hole 14 and the center of the winding shaft 11 to be brought together. In particular, in pegs in which a plurality of winding shafts are provided to one main body, and it is extremely difficult to coincide the centers of all the winding shafts with the holes of the head. In addition, in a guitar such as a classical guitar in which the mounting surface of the main body is tapered, in order to pass the winding shaft through the mounting surface, it is necessary to form a hole perpendicularly to the center line of the head. As a result, the distance of gaps easily vary, and moreover, the hole tends to be formed with a bend. As a result, as shown in FIG. 8, the winding shaft 11 and the worm wheel 12 are supported in an inclined condition. Consequently, there is a large amount of frictional rotation of the winding shaft 11 and the bushing 15, and thus the winding shaft 11 is not easily rotated due to the string tension. Accordingly, similar problems to those described above which are caused by the backlash of the gears, are generated. Furthermore, as shown in FIG. 8, because the winding shaft 11 is inclined, there are problems in that the normal meshing of the worm wheel 12 and the worm gear 13 cannot be maintained and the surface of the teeth wear abnormally, or the edge of the worm gear 12 comes into contact with the inner surface of the main body 10 and a large force must be exerted in order to carry out tuning.

The present invention was completed by studying the problems described above, and an object of the present invention is to provide a peg in which the winding shaft can be rotated due to string tension and tilt of the winding shaft and movement of the winding shaft in the axial direction are controlled, thus solving the various problems described above.

SUMMARY OF THE INVENTION

A peg for a stringed instrument comprising, a main body mounted to the head of the stringed instrument, a worm wheel rotatably supported by the main body and having a winding shaft at one end portion, a worm gear rotatably supported by the main body, the wormgear meshing with the worm wheel and having a knob at one end portion thereof, a hole formed in the worm wheel and having a portion with a non-circular cross-section, a winding shaft main body formed in the winding shaft so as to wind a string, a closely fitting portion formed in the winding shaft and having a smaller diameter than that of the winding shaft main body, the closely fitting portion passing through a plate portion of the main body and closely fitting into the portion with the non-circular cross-section, a tightening device inserted in the hole and screwed to the closely fitting portion, wherein an axial cross-section of the closely fitting portion is slightly larger than an axial cross-section of the hole, and the closely fitting portion is pressed into the hole by tightning the tightening device.

In the peg having the above-described structure, because the closely fitting portion of the winding shaft is pressed into the hole in the worm wheel, there is no gap between the closely fitting portion and the hole. Accordingly, when the worm wheel is rotated by the worm gear, this rotation is transmitted in real time to the winding shaft. In addition, even if there are variations in the thickness of the plate portion of the main body caused by manufacturing error or variation in the thickness of the plating, by adjusting the amount by which the tightening means is tightened, the gap between plate portion and the worm wheel and also between the plate portion and the winding shaft main body can be fixed. Thus, by causing the gap to have the optimum dimension, the winding shaft can maintain a state in which it is rotated by the string tension, and also movement of the winding shaft in the axial direction and tilting thereof is controlled. Accordingly, in the winding device of the present invention, when the guitar is being tuned, the winding shaft is not affected by the backlash of the gears or any other type of idle, and the winding shaft can be rotated by the knob in real time. As a result, tuning becomes easier and moreover, the precision of the tuning is improved. Also, in the present invention, because the closely fitting portion is pressed into the hole by the tightening means being tightened, there is an advantage in that there is a great resistance to the rotation of the tightening means, and thus it is difficult for the tightening means to become loose.

It is preferable that the length of the closely fitting portion pressed into the hole be 0.1 to 0.4 mm. If the length of the closely fitting portion pressed into the hole is less than 0.1 mm, then the fixing force is insufficient, and thus both the worm wheel and the winding shaft rotate relative to each other due to moment generated between the two. In addition, a length of the closely fitting portion pressed exceeding 0.4 mm is undesirable since a large force is required in order to tighten the tightening means, and also a large internal stress is generated in the worm wheel. The length of the closely fitting portion to be pressed into the hole is more preferably 0.2 to 0.3 mm. For the same reasons described above, it is preferable that the axial cross-section of the closely fitting portion in the radial direction be larger than the axial cross-section of the hole in the same direction by 0.005 to 0.2 mm, and more preferably by 0.05 to 0.13 mm. Furthermore, the gap between plate portion and the worm wheel and between the plate portion and the winding shaft main body is preferably 0.1 to 0.2 mm, and by providing this gap, the winding shaft can be rotated smoothly by the string tension, and also inclination of the winding shaft or movement of the winding shaft in the axial direction is such that it is not problematic in most cases. It should be noted that this gap can be obtained by setting the length of the closely fitting portion to be 0.3 to 0.5 mm longer than the thickness of the plate portion, and pressing the closely fitting portion into the hole to a depth of 0.2 to 0.3 mm.

The portion of the closely fitting portion for introduction into the hole may be formed with a tapered configuration with the taper in the direction of the tightening means side. However, in this type of structure, when the closely fitting portion is pressed into the hole, the worm wheel transforms so as to expand, and thus it is difficult for the closely fitting portion and the worm wheel to maintain normal meshing. Accordingly, it is preferable that the portion of the closely fitting portion for introduction into the hole be formed so as to have a step portion which has a larger diameter than the end portion at the tightening means side, and this step portion shaves off the inner wall of the hole and is thereby fit into the hole. That is to say, the end portion is caused to be fastened into the hole, and by doing this, transformation of the worm wheel is controlled, and also the fixing strength of the closely fitting is increased. It should be noted that the length of the closely fitting portion pressed into the hole is controlled by using a tool, such as torque driver, which can set the torque at the time when the tightening means is being tightened.

Next, the second peg of the invention has, a main body for mounting at the head portion of the stringed instrument, and a worm wheel which was rotatably supported by the main body and having a winding shaft at one end portion, and a worm gear which was rotatably supported by the main body and having a knob at one end portion, and which was meshed with the worm wheel, and a hole having a portion with a non-circular cross-section is formed in the worm wheel, and a winding shaft has a winding shaft main body and a closely fitting portion, and string is wound around the winding shaft main body, and the closely fitting portion was passed through the plate portion of main body and has a smaller diameter than the winding shaft main body, and the closely fitting portion being screwed in by being closely fitted in the portion of the hole having a non-circular cross-section and then inserting the tightening means into the hole, wherein an elastic member and a flat washer are disposed, in that order, between the plate portion and the winding shaft main body, from the winding shaft main body toward the plate portion.

In the peg having the above-described structure, the plate portion of the main body is nipped between the worm wheel and the winding shaft main body by the elasticity force of an elastic member. By suitably selecting the elasticity force of the elastic member, the winding shaft can be rotated smoothly by the string tension, and movement of the winding shaft in the axial direction, and inclination thereof and the like is controlled. In addition, in the above structure, the right angle of the winding shaft with respect to the plate portion can be tightened. Thus, even in the bushing type peg specifically, in which the center of the bushing easily shifts with respect to the winding shaft, it is unlikely that the winding shaft will be mounted in a state in which it is tilted.

In the present invention, an elastic member and a flat washer are disposed between the plate portion and the winding shaft, in that order, and this is an important feature of the invention. That is to say, with this structure, because the bottom surface of the worm wheel is disposed on top of the plate portion of the main body, it is unlikely that that the winding shaft will tilt. In addition, because the plate portion is nipped between the worm wheel and the flat surface of the flat washer, it is even less likely for the winding shaft to tilt. Furthermore, since the winding shaft which has a smaller diameter than the worm wheel does not generally contact the plate portion directly, wearing of the plate portion caused by rotation of the winding shaft is prevented. Accordingly, in the second winding shaft of the present invention also, when the guitar is being tuned, the winding shaft is not affected by the backlash of the gears or by any other type of idle, and the winding shaft can be rotated by the knob in real time. As a result, tuning becomes easier, and moreover, the precision of the tuning is increased. It should be noted that this effect is even greater if a flat washer similar to that described above is disposed between the winding shaft main body and the elastic member.

The elastic member is preferably a plate-spring. Examples of elastic members which may used, other than a plate spring, are: a spring washer having a wave configuration in the circumferential direction thereof; a coil spring; and a washer formed of an elastic material such as rubber or synthetic resin. The flat washer is preferably a synthetic resin washer or metal washer having a lubrication coat on the surface thereof. Specific examples include: a synthetic resin including a polyacetal resin having no less than 10% by weight of polytetrafluoroethylene; a metal washer having solidifying lubricant such as molybdenum disulphide or the like coated on the surface thereof; or a metal washer on whose surface a mixed coat was disposed by coating with a dispersion solution of a plating solution and Teflon Resin (trademark). By using this type of flat washer, frictional resistance of the plate portion and the flat washer is reduced, and wear of the plate portion is also controlled.

The above-described features of the second invention may be favorably provided along with feature of the first invention. That is to say, in the first invention, in the case where the length of the closely fitting portion which is pressed into the hole is controlled by the tightening force of the tightening means, due to variation of the winding shaft processing precision, variation of the hardness of the worm wheel, or variation in the thickness of the plating, even when the tightening means is tightened with the same force, variation in the length of the closely fitting portion which is pressed in is generated. As a result, the length of the closely fitting portion pressed in may be increased and the plate portion is tightened more intensely by the winding shaft main body and the worm wheel. Thus the winding shaft can no longer be easily rotated due to the string tension. On the other hand there is the concern that idle of the winding shaft in the axial direction and inclination of the winding shaft will be generated if the length of the closely fitting portion which is pressed in is short. To solve this problem, it is preferable that the axial cross-section of the closely fitting portion be made slightly larger than the axial cross-section of the hole, and that by the tightening means being tightened, the closely fitting portion be pressed into the hole, and also that an elastic member and a flat washer be disposed, in this order, between the plate portion and the winding shaft main body, from the winding shaft main body toward the plate portion.

DETAILED DESCRIPTION OF THE INVENTION

The present invention will be described with reference to FIGS. 1 to 5.

Figure 1:
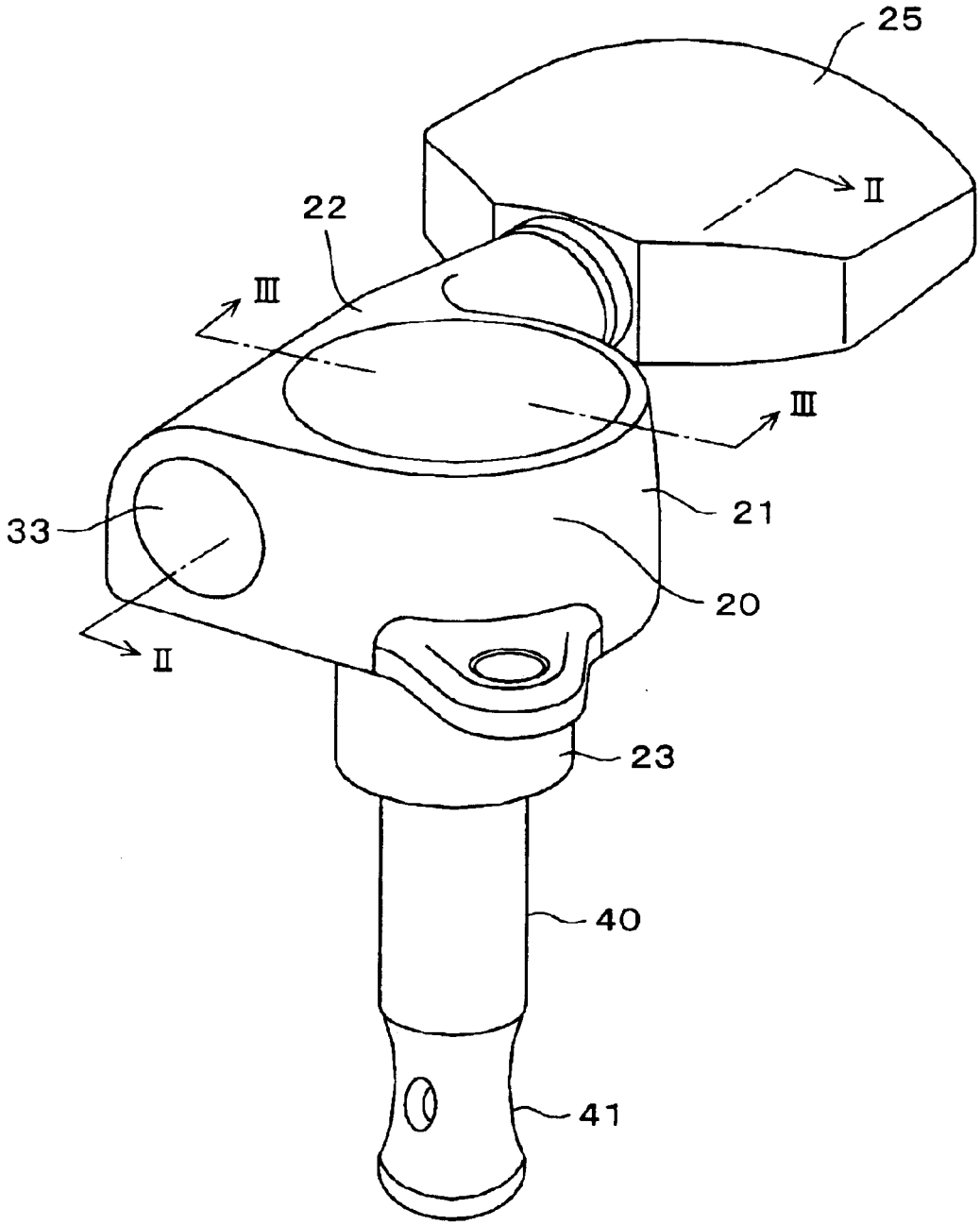
FIG. 1 is a perspective view of a peg of an embodiment of the present invention.

FIG. 1 is an assembly drawing of the peg of an embodiment of the present invention. In the drawings, reference numeral 20 is the housing (main body). The housing 20 comprises: a gear case portion 21 disposed on the back surface of the head H, a worm case portion 22 which extends sideward from the gear case portion 21; and a mounting portion 23 which fits into the mounting hole Ha which is formed on the head H. Also, the gear case portion 21 and the mounting portion 23 are brought into contact with each other by the plate portion 24 which has a fixed thickness.

Figure 5:
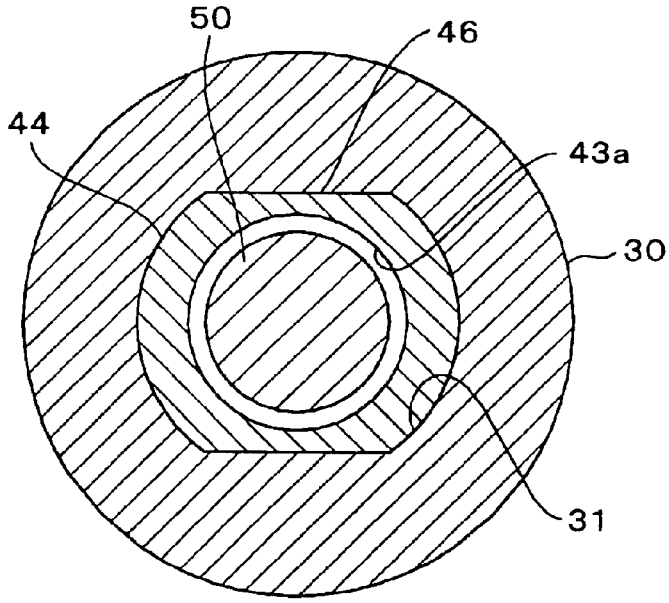
FIG. 5 is a cross-sectional view taken along line V—V of FIG. 2.

The worm gear 33 is rotatably supported in the worm case portion 22. One end portion of the worm gear 33 extends from the worm case portion 22, and a knob 25 is mounted thereto. A worm wheel 30 which is accommodated in the gear case portion 21 is closely fitted with the worm gear 33. As shown in FIG. 5, a non-circular closely fitting portion (hole) 31 which is shaped like a circle with both sides cut in parallel, and a large diameter portion 32 having a circular cross-section and an inner diameter which is slightly larger than that of the closely fitting portion 31, are formed in the worm wheel 30.

A hole 24*a* is formed in the plate portion 24 of the housing 20, and the winding shaft 40 passes through the hole 24*a*. The winding shaft 40 includes a winding shaft main body 42 having a surface for winding 41 and an closely fitting portion 43 having a slightly smaller diameter than that of the winding shaft main body 42. Furthermore, the closely fitting portion 43 includes a large diameter closely fitting portion 44 and a small diameter closely fitting portion 45 having a slightly smaller diameter than the large diameter closely fitting portion 44. The diameter of the small diameter closely fitting portion 45 is a little smaller than that of the closely fitting portion 31 of the worm wheel 30. The difference between these sizes in the radial direction is set at 0.005 to 0.2 mm, and in this embodiment, it is 0.11 mm. In addition, at the outer periphery of the closely fitting portion 43, side portions are cut out to form flat portions 46 which are parallel to each other. The flat portions 46 are formed so as have a portion extending along the entire length of the small diameter closely fitting portion 45, and along a portion of the large diameter closely fitting portion 44. The span dimension of the flat portions 46 is set so as to be slightly less than the span dimension of the flat portion of the closely fitting hole portion 31.

The boundary between the large diameter closely fitting portion 44 and the small diameter closely fitting portion 45 is formed as a step portion 47 which crosses the axial direction at right angles. In addition, the small diameter closely fitting portion 45 is fit loosely into the closely fitting hole portion 31, while the large diameter closely fitting portion 44 is pressed into the closely fitting hole portion 31. The closely fitting portion 43 is mounted to the worm wheel 30 by the screw (tightening means) 50 inserted from the large diameter hole portion 32 of the worm wheel 30 being screwed into the screw hole 43 in the worm wheel 30.

When the small diameter closely fitting portion 45 is inserted into the closely fitting hole portion 31, the step portion 47 abuts the edge of the closely fitting hole portion 31 and the small diameter closely fitting portion 45 cannot be inserted in any furthermore. If the screw 50 is tightened in this state, the step portion 47 shaves the inner wall of the closely fitting hole portion 31 as the screw is tightened. Thus, the large diameter closely fitting portion 44 is in a state of being fastened to the inner wall of the closely fitting hole portion 31. That is the large diameter closely fitting portion 44 has been pressed into the closely fitting hole portion 31. The length h of the large diameter closely fitting portion 44 which has been pressed in is set to be 0.2 to 0.3 mm. The flat portion 46 which is formed on the large diameter closely fitting portion 44 reaches furthermore to the outer side than the portion of the large diameter closely fitting portion 44.

Figure 2:
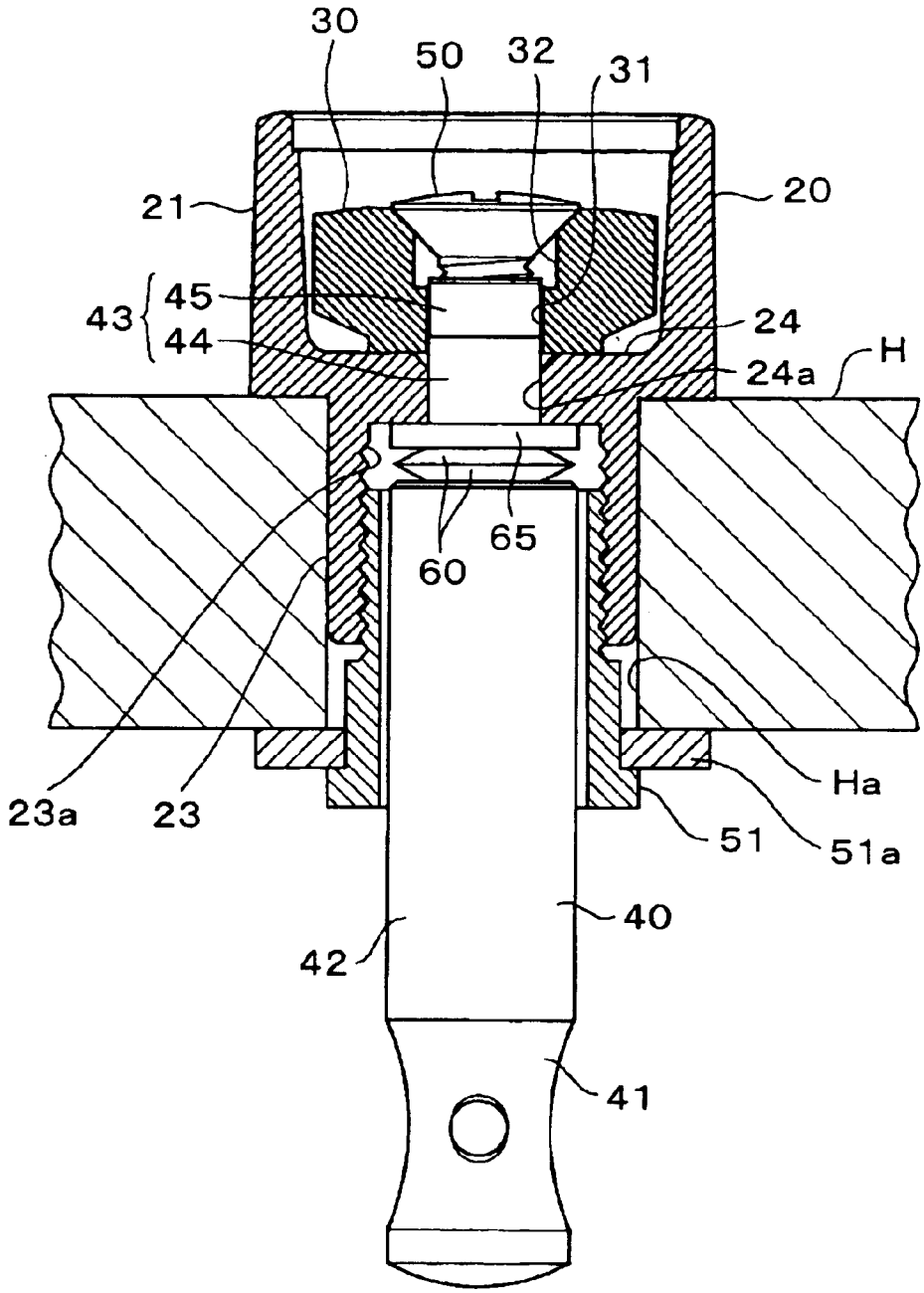
FIG. 2 is a cross-sectional view taken along line II—II of FIG. 1.
Figure 3:
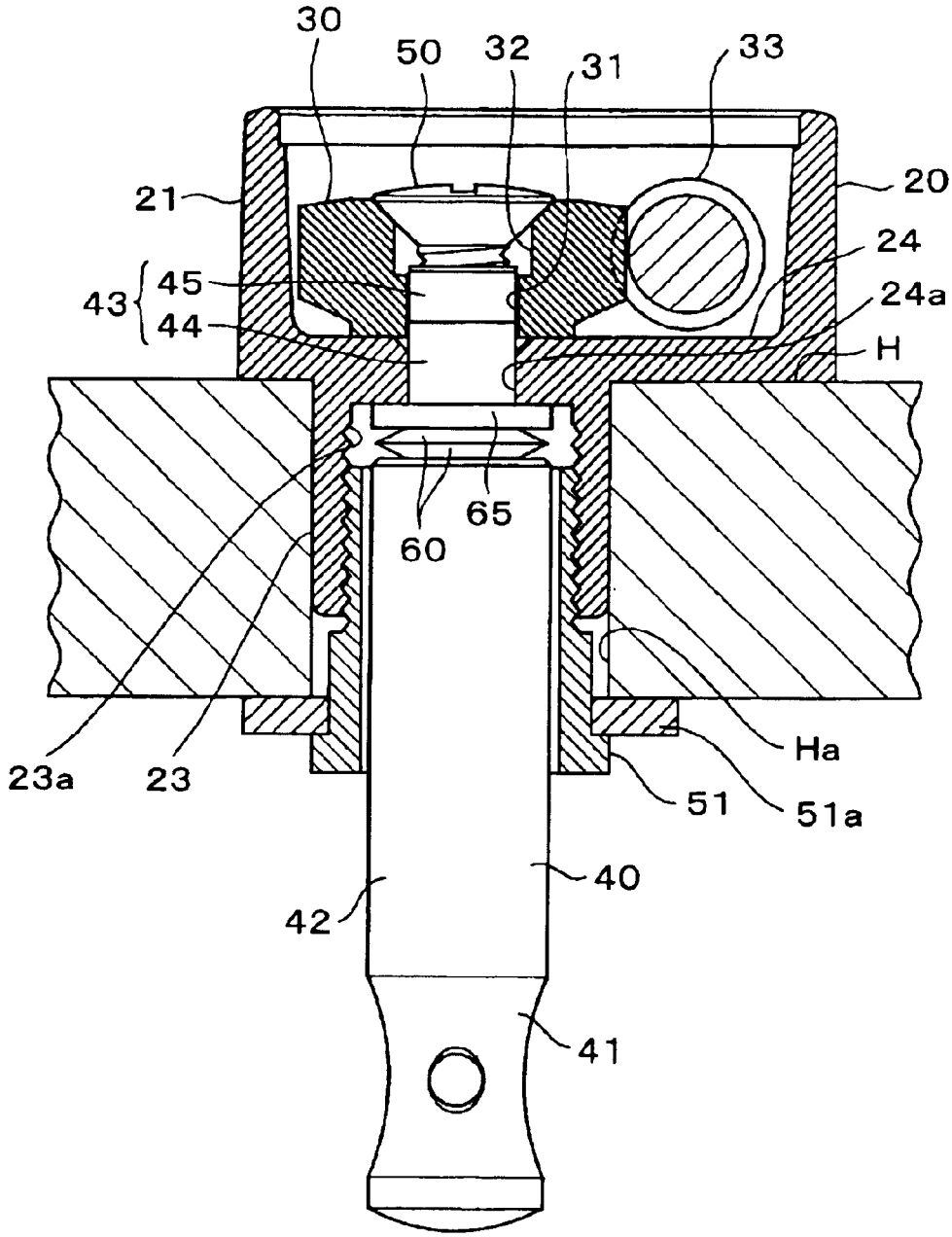
FIG. 3 is a cross-sectional view taken along line III—III of FIG. 1.
Figure 4:
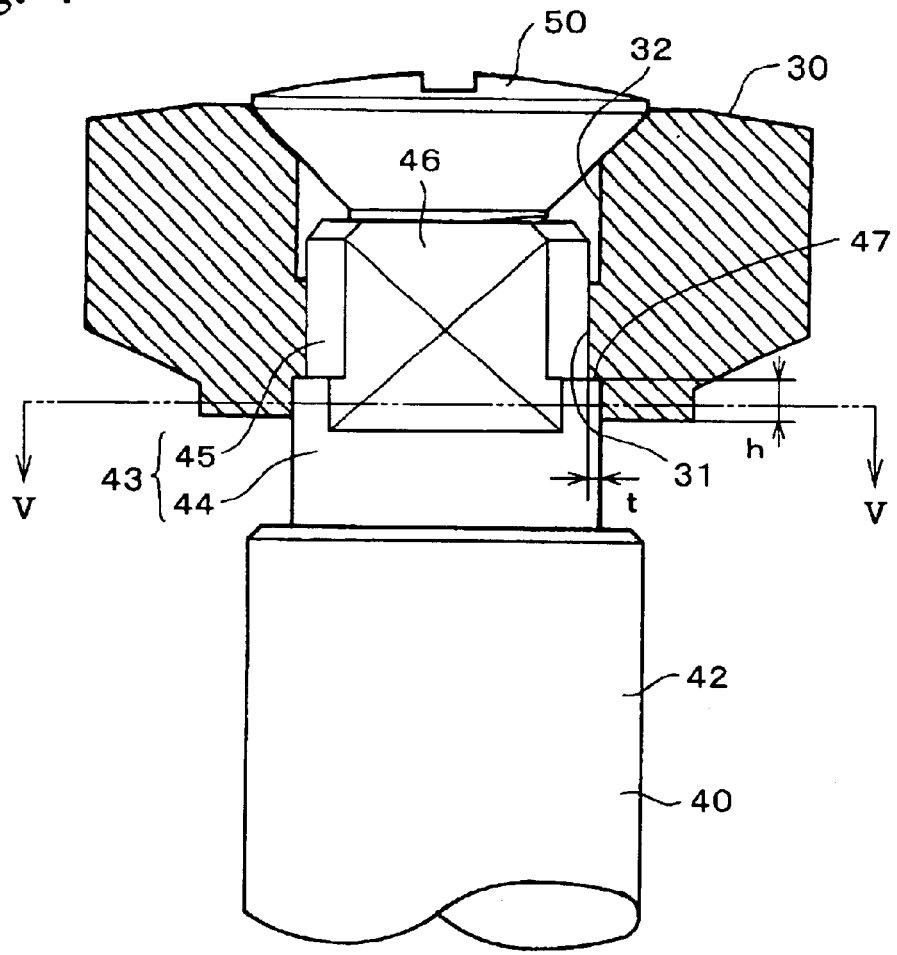
FIG. 4 is a cross-sectional view of an enlarged main portion of the peg of the embodiment.

As shown in FIG. 2, a screw 23*a* is formed in the inner periphery of the mounting portion 23 of the housing 20. A securing nut 51 which passes through the winding shaft main body 42 is screwed together with the screw 23*a* via a washer 51*a*. The peg of this embodiment is thus mounted to the head H. It should be noted that the winding shaft 42 is closely fitted loosely with the inner surface of the securing nut 51, and since the winding shaft 42 is guided at the inner surface of the securing nut 51, inclination thereof is controlled.

As also shown in FIG. 2, a pair of spring plates (elastic members) 60 and a flat washer 65 are disposed between the plate portion 24 of the housing 20 and the winding shaft main body 42. The spring plates 60 is preferably formed from a material having springiness such as a spring steel. Also, the flat washer 65 is preferably: a synthetic resin including a polyacetal resin having no less than 10% by weight of polytetrafluoroethylene. The plate portion 24 is nipped between the bottom surface of the worm wheel 30 and the flat washer 65 by the elastic force of the plate spring 60.

Due to the structure described in the foregoing, the worm wheel 30 and the winding shaft 40 are rotatably supported by the plate portion 24, and they can rotate due to string tension.

In the peg having the above-described structure, the large diameter closely fitting portion 44 of the winding shaft 40 is pressed into the closely fitting hole portion 31 of the worm wheel 30, and thus a gap is formed between the large diameter closely fitting portion 44 and the closely fitting hole portion 31. Accordingly, when the worm wheel 30 is rotated by the worm gear 33, the rotation is transmitted to the winding shaft 40 in real time.

In addition, in the peg described above, the plate portion 24 of the housing 20 is nipped between the worm wheel 30 and the winding shaft main body 42 by the elasticity force of the plate springs 60. Thus, the winding shaft 40 can be rotated smoothly due to string tension, and also movement or inclination of the winding shaft 40 in the axial direction is suppressed. In addition, in this type of peg, the bottom surface of the worm wheel 30 is disposed on the plate portion 24, and the plate portion 24 is nipped between the worm wheel 30 and the flat surface of the flat washer 65, and thus it is even less likely that the winding shaft will tilt. Furthermore, since the winding shaft 40 does not contact the plate portion 24 directly, wear of the plate portion 24 caused by the rotation of the winding shaft 40 is prevented.

Accordingly, in the peg having the above described structure, when tuning is carried out, the winding shaft is not affected by the backlash of the gears or by any other type of idle, and the winding shaft can be rotated by rotation of the knob in real time. As a result, tuning becomes easier, and moreover, the precision of the tuning is increased. Also, in the present invention, because the large diameter closely fitting portion 44 is pressed into the closely fitting hole portion 31 by the screw 50 being tightened, there is a great resistance to the rotation of the screw 50, and thus it is difficult for the screw 50 to loosen. In addition, even if there are variations in the thickness of the plate portion 24 caused by manufacturing error or variation in the thickness of the plating, by adjusting the amount by which the screw 50 is tightened, the amount by which the plate spring 60 is compressed can be kept fixed. Thus, even if there is error in the sizes of the parts, the winding shaft 40 can maintain a state in which it is rotated by the string tension, and in addition movement of the winding shaft 40 in the axial direction and slanting thereof is controlled.

Figure 6:
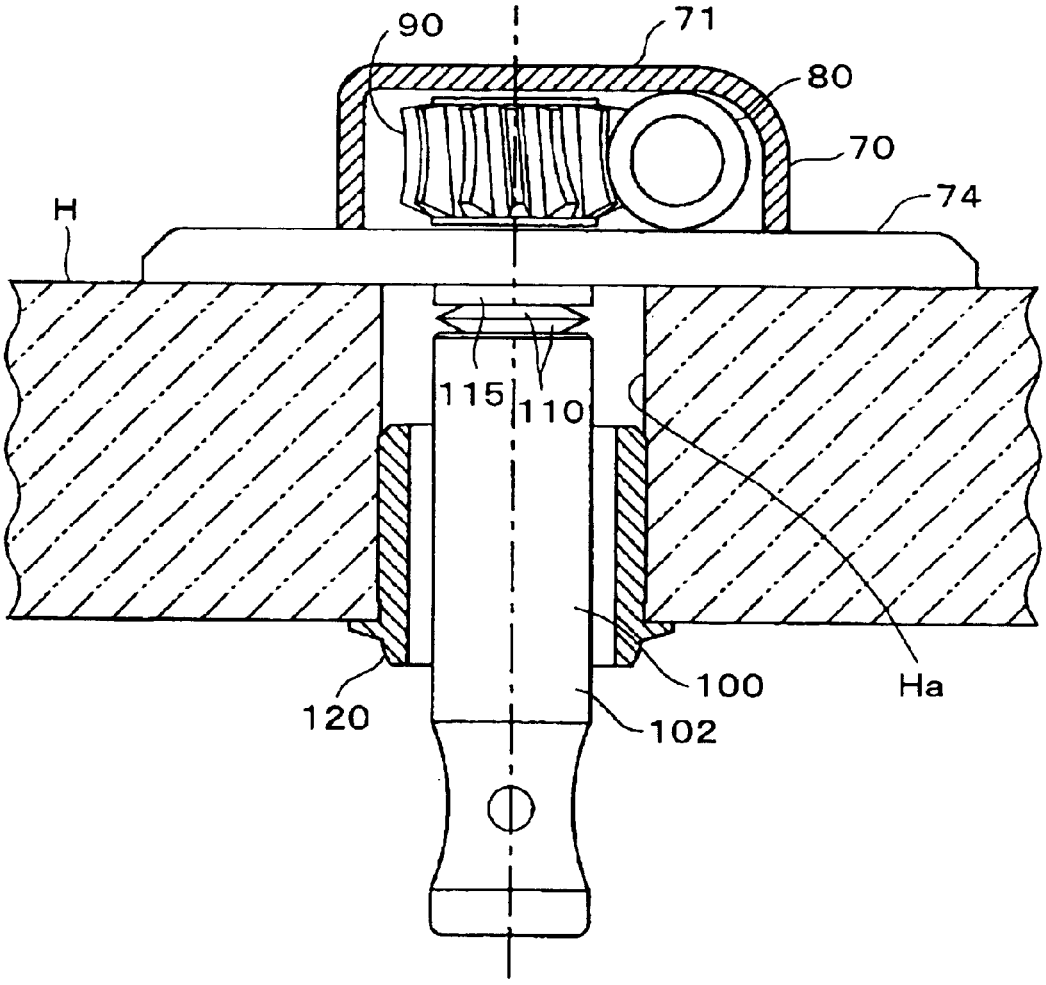
FIG. 6 is a cross-sectional view of a peg of another embodiment of the present invention.
Figure 7:
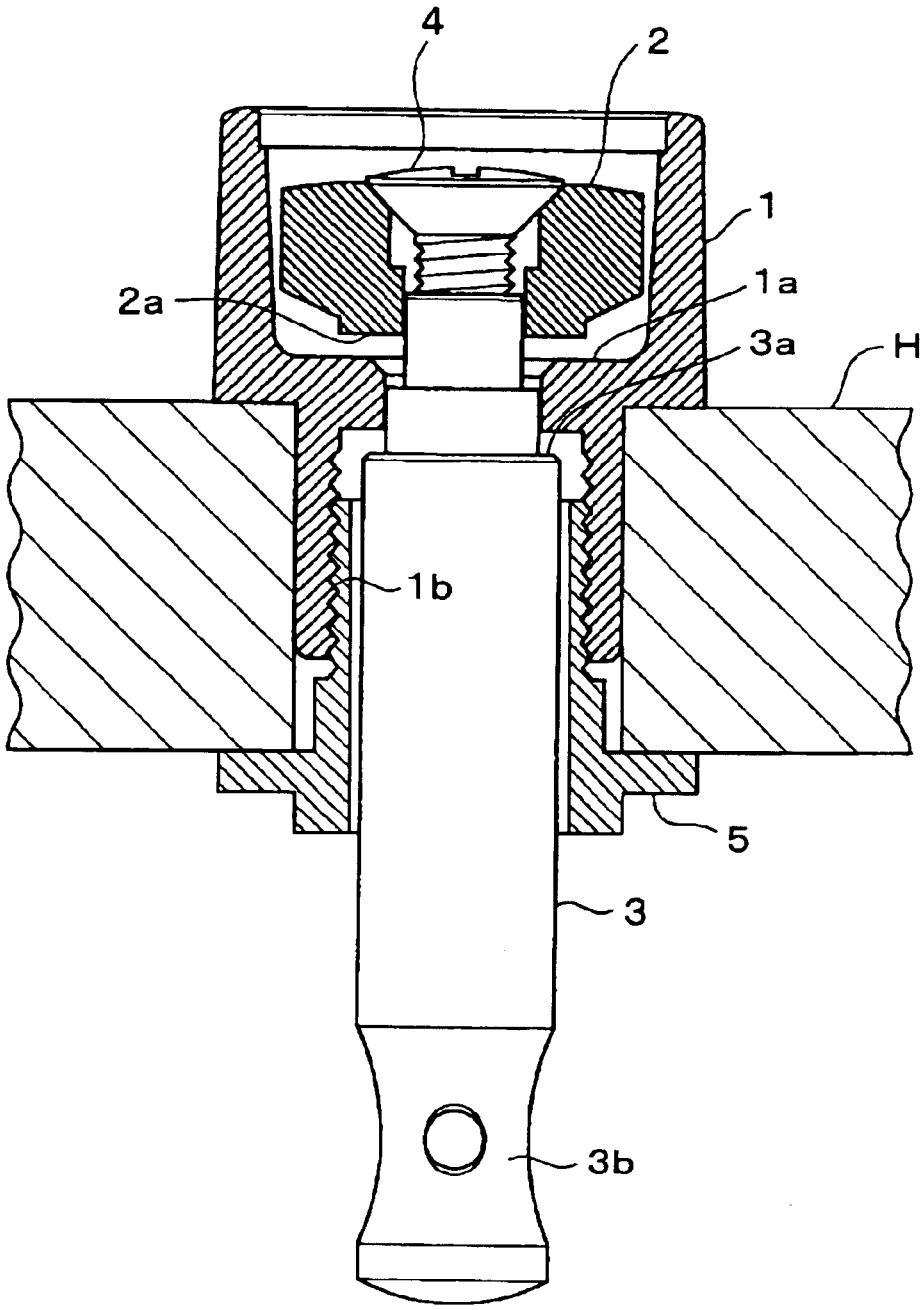
FIG. 7 is a cross-sectional view of a peg of the prior art.
Figure 8:
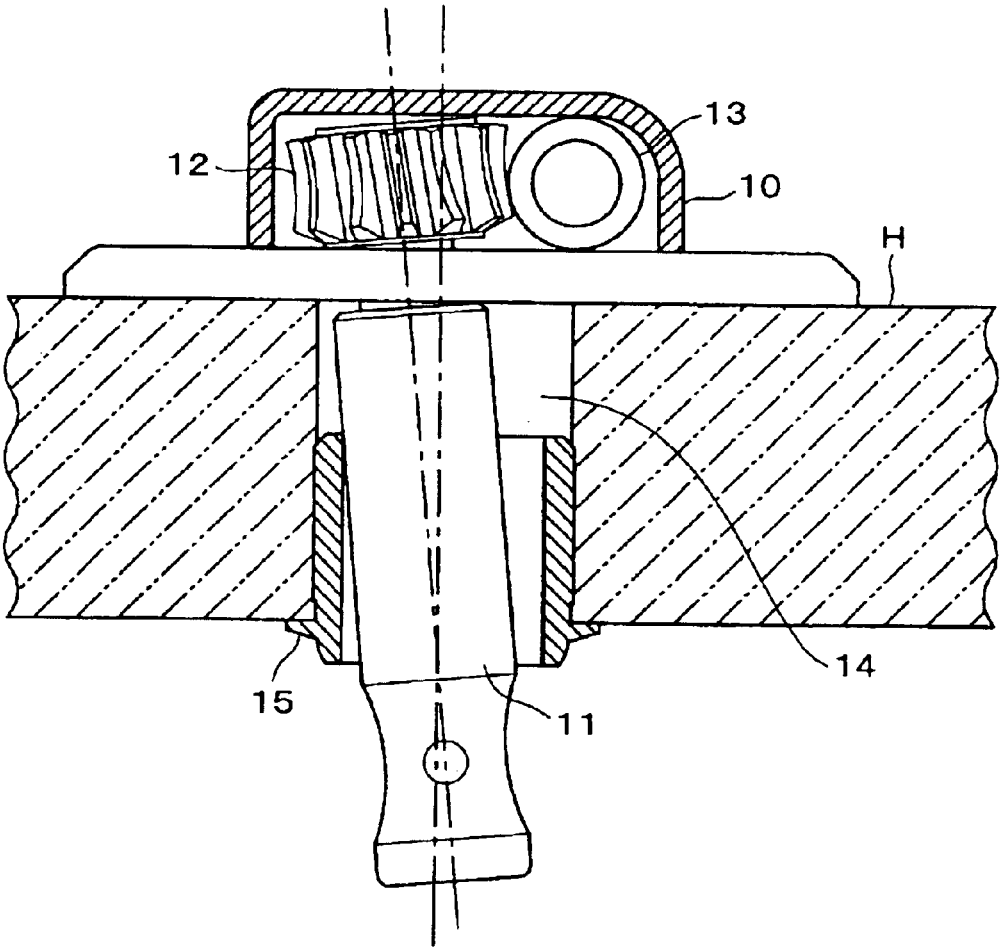
FIG. 8 is a cross-sectional view of another peg of the prior art.

FIG. 6 is a cross-sectional view of another embodiment of the present invention. In this figure, reference numeral 70 is the housing (main body) and the housing 70 comprises a main body portion 71 and a plate portion 74. A worm gear 80 having a knob (not shown) mounted to one end thereof is rotatably supported by the main body portion 71, and a worm wheel 90 is screwed together with the worm gear 80. As in the structure of the embodiment described above, a mounting shaft 100 engages with the worm wheel 90, and the mounting shaft 100 and the worm wheel 90 are mounted to each other with a screw not shown. Also, a pair of plate springs 110 and a flat washer 115 are disposed between the winding shaft main body 102 of the winding shaft 100 and the plate portion 74. In addition, the bushing 120 is fit into the hole Ha which is formed in the head H and the winding shaft 100 is inserted into the bushing 120.

In the bushing type peg, there is a tendency for the center of the bushing 120 to be mispositioned with respect to the center of the winding shaft 100. However, in the embodiment described above, the winding shaft 100 is tightened at right angles with respect to base portion plate portion 74 by the plate springs 110, and thus there are very few cases where the winding shaft 100 is mounted in a state in which it is tilted.

It should be noted that the present invention may be suitably applied to all kinds of stringed instruments such as acoustic guitars, electric guitars, electric-acoustic guitars, bass guitars, mandolins, ukuleles and the like.

What is claimed is:

1. A peg for a stringed instrument comprising:

a main body mounted to the head of the stringed instrument;

a worm wheel rotatably supported by the main body and having a winding shaft at one end portion;

a worm gear rotatably supported by the main body, the wormgear meshing with the worm wheel and having a knob at one end portion thereof;

a hole formed in the worm wheel and having a portion with a non-circular cross-section;

a winding shaft main body formed in the winding shaft so as to wind a string;

a closely fitting portion formed in the winding shaft and having a smaller diameter than that of the winding shaft main body, the closely fitting portion passing through a plate portion of the main body and closely fitting into the portion with the non-circular cross-section;

a tightening device inserted in the hole and screwed to the closely fitting portion;

wherein an axial cross-section of the closely fitting portion is slightly larger than an axial cross-section of the hole, and the closely fitting portion is pressed into the hole by tightning the tightening device.

2. The peg for a stringed instrument according to claim 1, wherein the length of the portion closely fitting portion which is pressed into the hole is 0.1 to 0.4 mm, and the axial cross-section of the closely fitting portion is 0.005 to 0.2 mm larger than the axial cross-section of the hole in a radial direction.

3. The peg for a stringed instrument according to claim 1, wherein the closely fitting portion has an introducing portion for introducing the closely fitting portion into the hole, the introducing portion is a step portion having a larger diameter than that of an end portion at the tightening device side, and the step portion is closely fitted into the hole by shaving the inner wall portion of the hole by the step portion.

4. The peg for a stringed instrument according to claim 1, wherein the plate portion of the main body is disposed between the worm wheel and the winding shaft, and an elastic member and a synthetic resin washer or a metal washer having a lubricating coating on a surface thereof are disposed in that order between the plate portion and the winding shaft in a direction from the winding shaft toward the plate portion.

5. A peg for a stringed instrument comprising:

a main body mounted to the head of the stringed instrument;

a worm wheel rotatably supported by the main body and having a winding shaft at one end portion;

a worm gear rotatably supported by the main body, the wormgear meshing with the worm wheel and having a knob at one end portion thereof;

a hole formed in the worm wheel and having a portion with a non-circular cross-section;

a winding shaft main body formed in the winding shaft so as to wind a string;

a closely fitting portion formed in the winding shaft and having a smaller diameter than that of the winding shaft main body, the closely fitting portion passing through a plate portion of the main body and closely fitting into the portion with the non-circular cross-section;

a tightening device inserted in the hole and screwed to the closely fitting portion;

wherein an elastic member and a flat washer are disposed in that order between the plate portion and the winding shaft main body in a direction from the winding shaft main body toward the plate portion, and a bottom surface of the worm wheel is put on the plate portion.

6. The peg for a stringed instrument according to claim 5, wherein the elastic member is a coned disc spring, and the washer is a synthetic resin washer or a metal washer having a lubricating coating on a surface thereof.

* * * * *